US005390377A

United States Patent [19]

Blough

[11] Patent Number: 5,390,377

[45] Date of Patent: Feb. 21, 1995

[54] SHEET FOR CONVERTING HOT TUB TO WADING POOL

[76] Inventor: Mark W. Blough, 2922 Cambridgeshire Rd., Carrollton, Tex. 75007

[21] Appl. No.: 154,877

[22] Filed: Nov. 19, 1993

[51] Int. Cl.[6] ..... A47K 3/024; A47K 3/12

[52] U.S. Cl. ..... 4/495; 4/541.1; 4/572.1; 4/573.1

[58] Field of Search ..... 4/494, 495, 500, 501, 4/504, 541.1, 559, 571.1, 573.1, 578.1, 579, 580, 589, 590, 592, 572.1, 593, 581, 582, 583

[56] References Cited

U.S. PATENT DOCUMENTS

| | | | |
|---|---|---|---|
| 1,239,642 | 9/1917 | Tolley | 4/583 |
| 1,454,112 | 5/1923 | Graves | 4/571.1 |
| 1,650,067 | 11/1927 | Graves | 4/572.1 |
| 1,726,753 | 9/1929 | Mirkin | 4/572.1 |
| 1,739,078 | 12/1929 | Mapes et al. | 4/494 |
| 1,758,071 | 5/1930 | Bleustein | 4/572.1 |
| 2,547,564 | 4/1951 | Burke | 4/572.1 |
| 2,589,280 | 3/1952 | Ocana | 4/590 |
| 2,607,925 | 8/1952 | De Puy | 4/548 |
| 2,944,264 | 7/1960 | Gagne et al. | 4/495 |
| 3,041,631 | 7/1962 | Fogle | 4/495 |
| 3,052,893 | 9/1962 | McClure | 4/495 |
| 3,242,503 | 3/1966 | Russo | 4/495 |
| 3,595,224 | 7/1971 | Walter | 4/573.1 X |
| 3,813,703 | 6/1974 | Beaudin, Jr. | 4/494 X |
| 3,837,019 | 9/1974 | Hoff | 4/572.1 |
| 3,872,522 | 3/1975 | Bennett et al. | 4/498 |
| 3,874,005 | 4/1975 | Badon | 4/495 X |
| 3,935,600 | 2/1976 | Scribner | 4/495 |
| 3,942,199 | 3/1976 | Kollsman | 4/583 |
| 3,962,734 | 6/1976 | Chase | 4/494 X |
| 4,133,061 | 1/1979 | Hurd | 4/236 |
| 4,192,024 | 3/1980 | Zigmont | 4/496 |
| 4,236,259 | 12/1980 | Wendt | 4/498 |
| 4,271,542 | 6/1981 | Wood et al. | 4/495 |
| 4,340,982 | 7/1982 | Hart et al. | 4/497 X |
| 4,429,683 | 2/1984 | Hull | 4/498 X |
| 4,512,044 | 4/1985 | Clark | 4/581 |
| 4,656,678 | 4/1987 | Lipski | 4/578.1 |
| 4,807,309 | 2/1989 | Cushing | 4/494 |
| 4,890,342 | 1/1990 | Cushing | 4/494 |
| 4,894,875 | 1/1990 | Oxley et al. | 4/581 X |
| 4,910,814 | 3/1990 | Weiner | 4/494 X |
| 4,991,238 | 2/1991 | Forrest | 4/498 |
| 5,025,512 | 6/1991 | Niimura | 4/495 |
| 5,092,000 | 3/1992 | Cushing | 4/494 |

FOREIGN PATENT DOCUMENTS

| | | | |
|---|---|---|---|
| 2436850 | 2/1976 | Germany | 4/573.1 |

*Primary Examiner*—Robert M. Fetsuga
*Attorney, Agent, or Firm*—Pravel, Hewitt, Kimball & Krieger

[57] ABSTRACT

This device provides a substantially flat, rigid sheet for converting a hot tub to a wading pool. The sheet is designed to set on the seat of a hot tub and cover the foot well section of the hot tub. The sheet is provided with a plurality of small holes to allow water and bubble circulation. The device includes hand holds to facilitate lifting the sheet for placement of the sheet in the hot tub and removal of the sheet from the hot tub.

17 Claims, 3 Drawing Sheets

SHEET FOR CONVERTING HOT TUB TO WADING POOL

BACKGROUND OF THE INVENTION

1. Field of the Invention

This invention relates to a device for placing in a hot tub for converting the hot tub to a wading pool. More particularly, this device consists of a flat sheet which is designed to be placed in a hot tub having a seat and a foot well section, the sheet setting on the seat and covering the foot well section, so as to prevent small children from falling or stepping into the foot well section.

2. Description of the Related Art

Many homes, townhomes, and apartments have hot tubs for the enjoyment of the owners or occupants. Hot tubs may be designed to complement a swimming pool or may be installed as a standalone facility. In either situation, the hot tub is typically designed with a seat and a foot well section, the user sitting on the seat and extending his legs into the foot well section, so as to relax in a sitting position. However, hot tubs or spas are generally unsuitable for small children unless under direct supervision because a small child may step into the foot well section of the hot tub, where the water depth is over the child's head, and may drown. Thus, there is a significant safety concern.

In use, warm water, with the possible addition of air bubbles, is circulated through the hot tub to provide the user with the relaxing feeling of warm water and air bubbles. Usually, a hot tub is designed to be approximately 3 feet in overall height with a seat around the circumference at a height of about 1½ feet, designed for an adult to comfortably sit on the seat and rest his feet in the foot well section, with the majority of his body being under water. This presents an unsafe condition for young children under about 3½ feet in height, in that the child may step off the seat into the foot well section where the water will be over the child's mouth and nose if the child is touching the bottom, thus requiring the child to float, swim or remove himself from the section or risk drowning. Thus, for many children under the age of about 5 who are less than about 3½ feet tall, there is a danger of stepping into the foot well section of a hot tub and consequently drowning. Also, for children between the ages of about 5 and 10, there is a need for a hot tub having a lower depth so that the about 5–10 year old child may enjoy the benefits of the hot tub without the concern of the child inadvertently slipping into the foot well section, while having a greater area with a lower depth in which to play.

Thus, there exists a need for a way of converting a hot tub having a seat and foot well section into a wading pool so as to selectively permit the hot tub to be converted to a wading pool for the safety and enjoyment of young children.

SUMMARY OF THE INVENTION

The present invention is a device which provides a means for converting a hot tub into a wading pool so as to protect against a small child stepping into the foot well section of the hot tub and potentially drowning or having other serious suffocation or water inhalation injuries. The device includes a rigid sheet, which is preferably a substantially flat, plastic sheet, designed to be placed in a hot tub having a seat and a foot well section, the sheet resting on the seat and covering the foot well section. The sheet preferably has a plurality of small holes over the foot well section providing for water circulation, and a lifting means to facilitate lifting the sheet to place it in the hot tub or to remove the sheet from the hot tub. The shape of the sheet generally conforms to the shape of the hot tub at the seat, such that there is relatively little horizontal movement of the sheet within the hot tub.

When one desires to convert a hot tub to a wading pool, all that is required is that the user place the flat sheet within the hot tub, resting it on the seat. This provides a safety feature to greatly limit the chances of a small child drowning in the hot tub and provides a safe and efficient play area for young children. When it is desired to convert the wading pool back to a hot tub, all that is required is that the sheet be removed. The present invention provides a means for greatly limiting the number of accidental drownings in hot tubs and also provides a safe and efficient way of converting a hot tub to a wading pool for the enjoyment of young children.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF EXEMPLARY EMBODIMENTS

Figure 1:
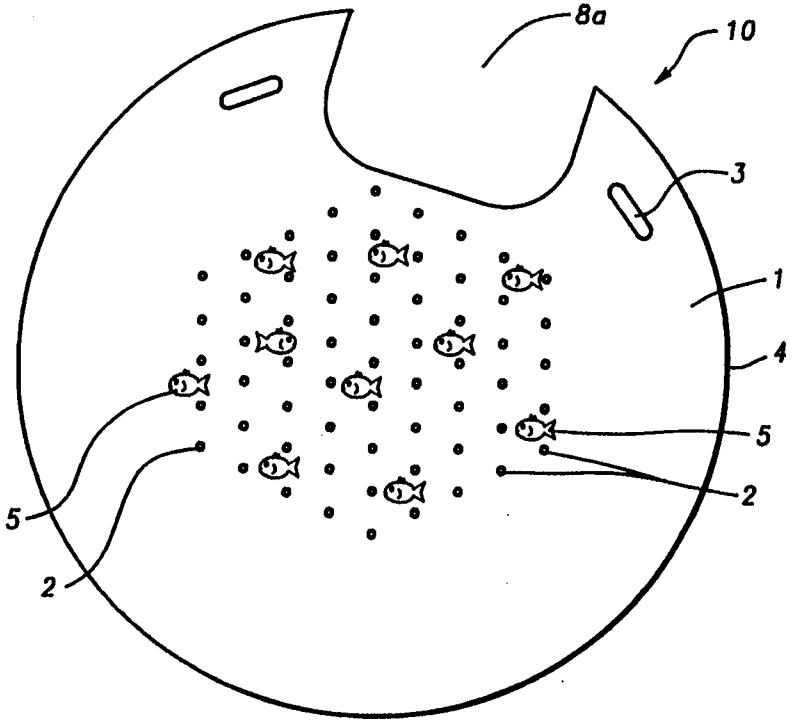
FIG. 1 is a top view of the device of the present invention.
Figure 2:
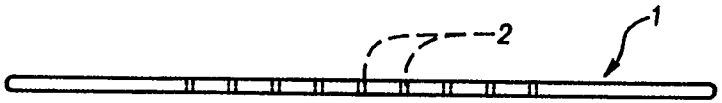
FIG. 2 is a side view of the embodiment shown in FIG. 1.

FIGS. 1 and 2 show one embodiment of the device 10 according to the present invention wherein the main component is a substantially flat sheet 1 having a plurality of small holes 2 located in the central section of the sheet 1. FIG. 1 shows a circular embodiment of the device 10 with large holes 3 located generally about the periphery 4 of the sheet 1 providing a means to lift the sheet 1 from a hot tub. FIG. 1 shows a further embodiment wherein decals 5 are attached to the sheet for various purposes as discussed below.

Figure 3:
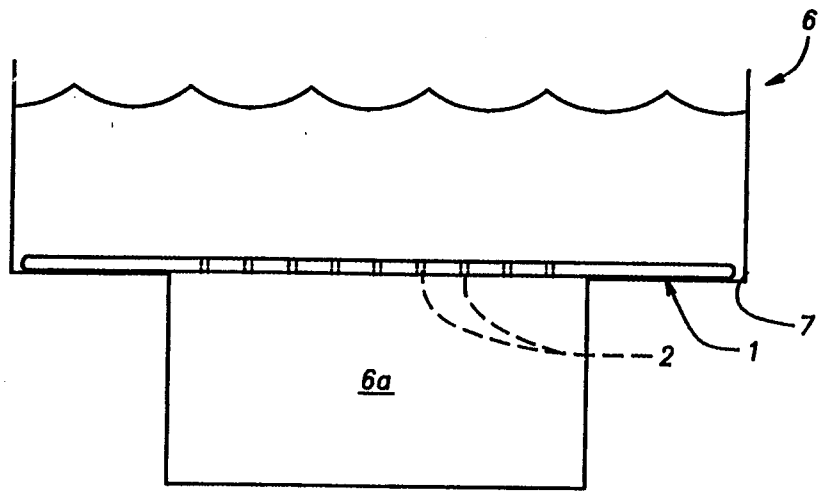
FIG. 3 is a side view of a hot tub with the sheet set on the seat of the hot tub.
Figure 4:
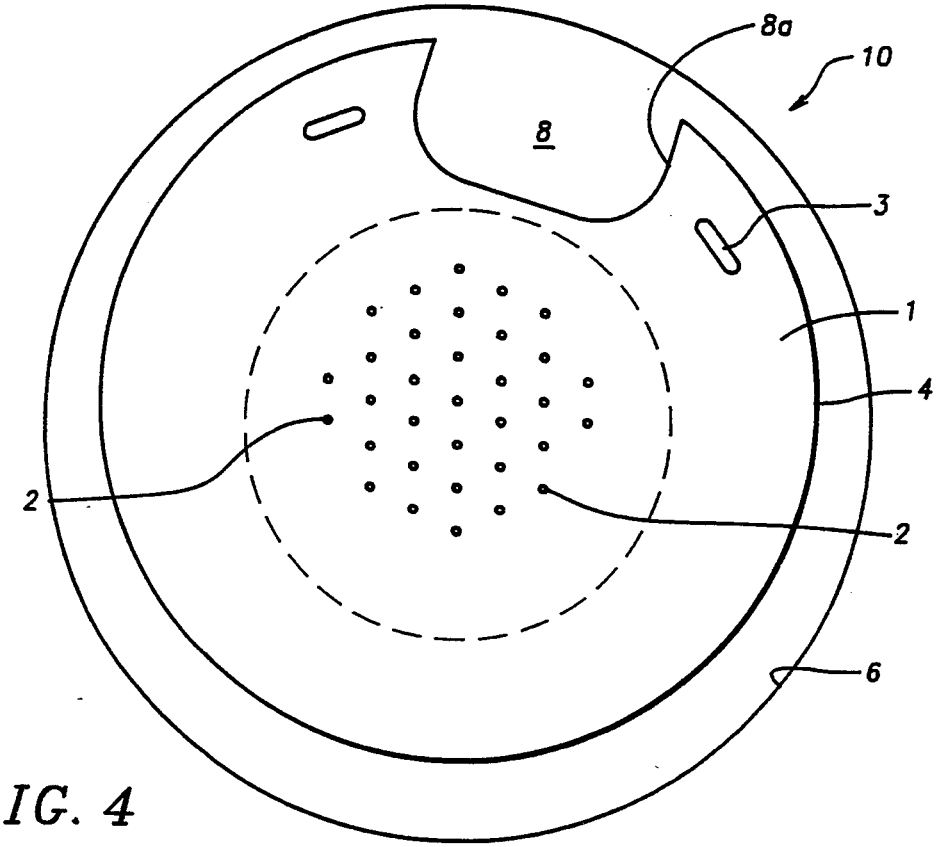
FIG. 4 is a top view of the hot tub and sheet shown in FIG. 3.

FIGS. 3 and 4 show the FIGS. 1 and 2 embodiment of the device 10 placed in a hot tub 6. As shown, the sheet 1 sets on the hot tub 6 seat 7 with the periphery 4 of the sheet 1 being designed to mate with, i.e., substantially match, the hot tub seat periphery *7a* so that excess movement of the sheet 1 does not occur, reducing the likelihood of a child falling should the sheet 1 move laterally. The periphery 4 of sheet 1 should be designed to include any necessary cutout portions 8*a* to accommodate any steps 8 or other protrusions which affect the general shape of the seat 7. The small holes 2 are generally located in the center of the sheet 1, above the foot well section 6*a* of the hot tub 6 to allow circulation of water and air in the foot well section 6*a*. Holes are not necessary on the area overlying the seat 7 as there is no water or air movement under those portions of the sheet 1.

As used herein, "hot tub" refers to any hot tub, whirlpool, JACUZZI ® or spa having a seat and a foot well section such that if a sheet were placed on the seat, it would form an area of suitable depth so as to be used as a wading pool.

The device 10 according to the present invention serves two purposes. First, it converts a hot tub 6 to a wading pool by covering the foot well section 6*a* of a hot tub 6 such that small children may safely play in the wading pool. Second, the device 10 provides a safety feature for a hot tub unattended by an adult. In the event that an unsupervised child climbs into the hot tub 6, the device 10 provides a level of safety in that the child can safely remain in the wading pool or exit the wading pool without falling into the foot well section 6*a*.

As shown, the main component of the device 10 is a substantially flat, substantially rigid sheet designed to be placed on the seat 7 of a hot tub 6 so as to cover the foot well section 6*a* of the hot tub 6. The sheet 1 may be made of plastic, metal, or other suitable material. Preferably, the sheet is made of plastic, such as PLEXIGLAS ®, acrylic, high density polyethylene, and high density polypropylene. Most preferably, the sheet is made of a polycarbonate plastic such as LEXAN ®, or an ABS plastic (acrylonitrile-butadiene-styrene).

Although the above-noted plastics are preferred for making sheet 1, other plastics or other materials may be used as long as they meet the following general criteria. The material should have a specific gravity over 1.0 so as to set on the seat portion 7 as opposed to floating in the hot tub 6. The material should be sufficiently rigid to support a significant weight over the foot well section 6a. The material should be weather resistant, i.e., resistant to ultraviolet radiation, chemical resistant, i.e., resistant to chlorine and other pool chemicals, and color stable. Also, the material should exhibit good impact strength, good adhesive properties for the application of paint or decals 5, and good machinability.

The sheet 1 may be designed with a textured, i.e., not smooth, surface so as to reduce an individual's slippage on the sheet 1. Also, both the upper and lower surfaces of the sheet 6 may be textured such that the sheet 1 may be placed with either side up.

The device 10 may include a plurality of decals 5 adhered to the surface of the sheet 1. The decals 5 serve two purposes. First, they provide additional resistance to slippage. Also, they provide a visual indication that the sheet 1 is placed within the hot tub 6. This may be desired because, depending upon the color of the hot tub 6 and sheet 1, it may be difficult to determine whether the sheet 1 is placed within the hot tub 6 without physically reaching into the hot tub to feel whether the sheet 1 is in place or not. Alternatively, printing may be applied to the sheet 1 in lieu of the decals 5.

Figure 8:
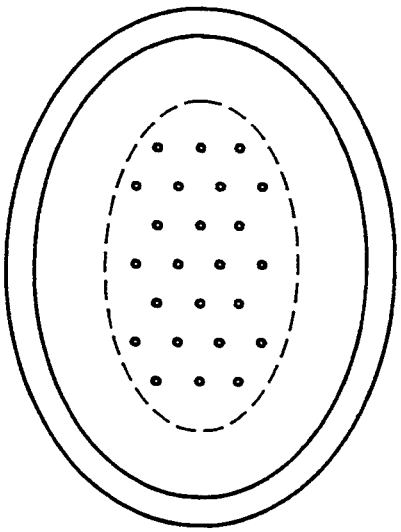
FIG. 8 shows a oval hot tub with an alternate, oval embodiment of the device of the present invention.

As shown in FIGS. 5 through 8, the device 10 according to the present invention may be shaped in a variety of ways to mate with a variety of shapes of hot tubs. Regardless of the shape, the device 10 has the general design parameters as discussed herein. For example, in FIG. 5, a square sheet 51 is installed within a square hot tub 56. The sheet 51 includes a plurality of small holes 52 for water circulation and several larger holes 53 for hand holds for lifting the sheet 51. The periphery 54 of the sheet 51 is designed to mate with the periphery 57 of the hot tub 56 at the seat portion. Other possible shapes of the device 10 include octagonal (FIG. 6), rectangular (FIG. 7) and oval (FIG. 8).

Figure 9:
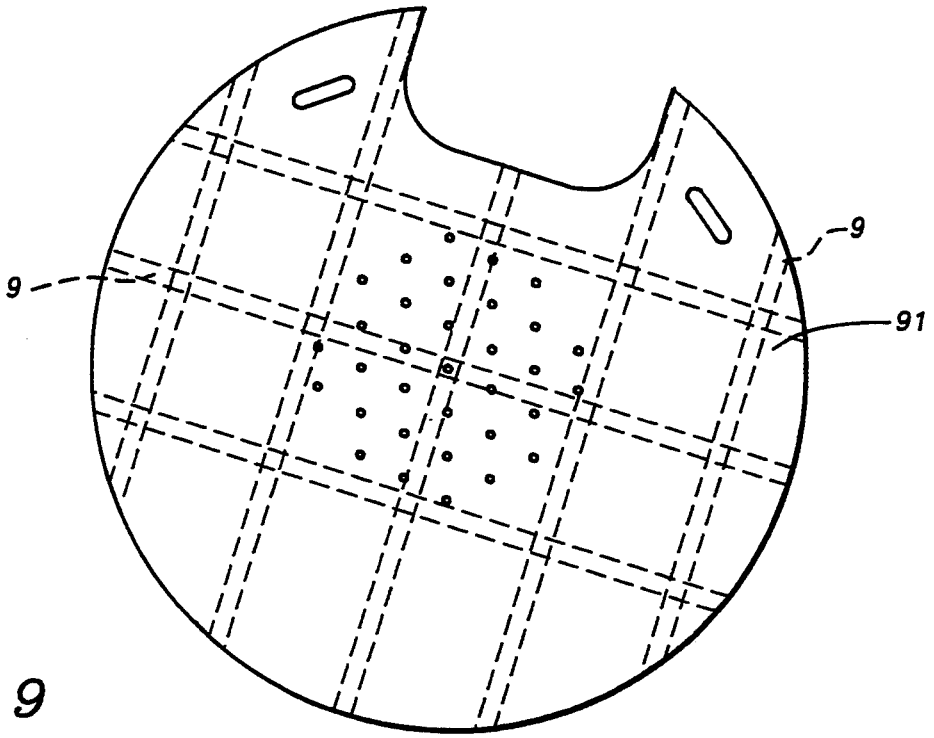
FIG. 9 is a top view of an alternate embodiment of the device having ribs on the bottom for additional support.
Figure 5:
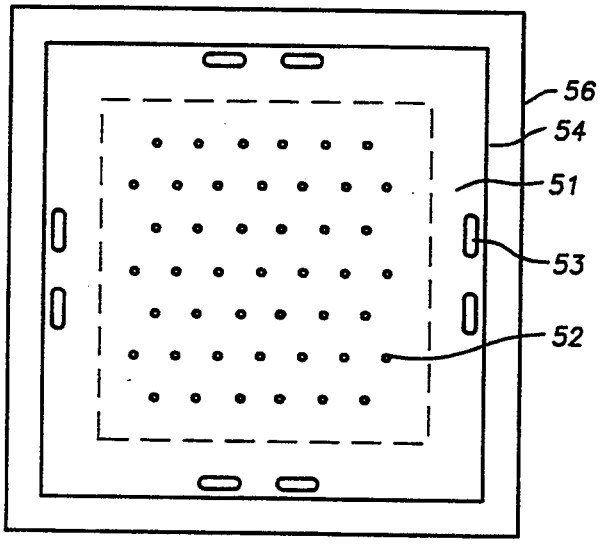
FIG. 5 shows a square hot tub with an alternate, square embodiment of the device of the present invention.
Figure 7:
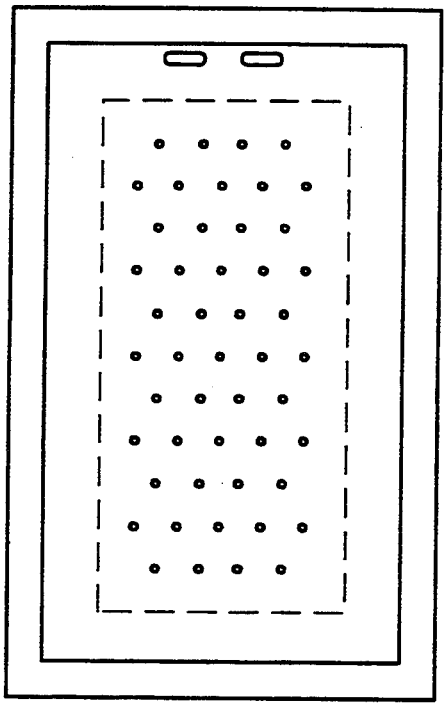
FIG. 7 shows a rectangular hot tub with an alternate, rectangular embodiment of the device of the present invention.
Figure 6:
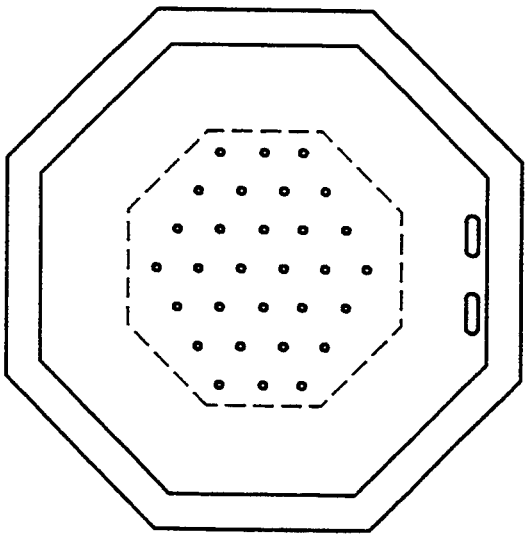
FIG. 6 shows a octagonal hot tub with an alternate, octagonal embodiment of the device of the present invention.

FIG. 9 shows an alternate embodiment of the present invention. Here, the device 10 includes a plurality of stiffening ribs 9 located on the bottom of the sheet 91. In other regards, the sheet 91 is designed with features as discussed herein. The ribs 9 provide additional strength and rigidity to the sheet 91, so as to support a greater weight. The embodiment of FIG. 9 may be manufactured with injection molding or other suitable processes.

Figure 10:
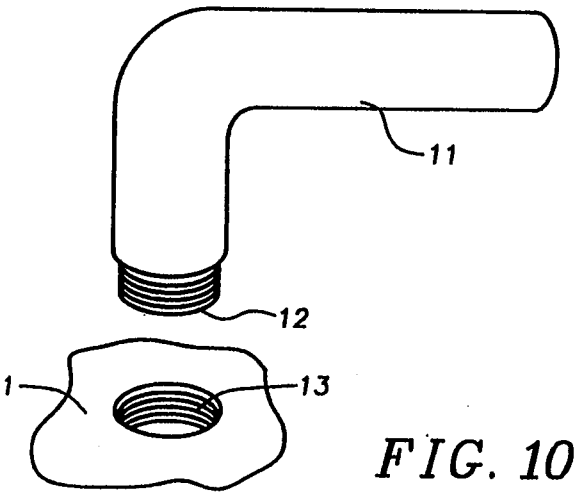
FIG. 10 shows a removable handle which may be used to facilitate lifting the device.

As used herein, "lifting means" refers to any means provided to facilitate lifting the sheet 1 to place it in the hot tub 6 and/or to remove the sheet 1 from the hot tub 6. For this purpose, it is preferable to use large holes 3, designed for hand holds, located about the periphery 4 of the device 10 such as shown in FIGS. 1 and 4. However, other lifting means may be suitable and easily determinable by those of skill in the art. For example, a removable (selectively engagable) handle may be temporarily attached to the sheet 1 for the purpose of lifting the sheet 1. The handle(s) may be temporarily attached to the sheet 1 in a variety of ways, e.g., FIG. 10 shows a handle 11 having a threaded section 12 which may be temporarily screwed into a female receptacle 13 on sheet 1 for the purpose of lifting the sheet 1.

Other than those embodiments discussed above, additional embodiments may be employed. The sheet 1 may be any color, for example white, blue, black, etc. Also, the sheet 1 may be clear, translucent or opaque.

The device 10 addresses the safety problems associated with hot tubs mentioned above by providing a safe, easy, and convenient means to convert a hot tub to a shallower, wading pool by covering the foot well section 6*a* of the hot tub 6.

Having described the invention above, various modifications of the techniques, procedures, material, and equipment will be apparent to those skilled in the art. It is intended that all such variations within the scope and spirit of the invention be included within the scopes of the appended claims.

What is claimed is:

1. A device for placing in a hot tub having a periphery, a seat at the periphery and a foot well section for converting the hot tub to a wading pool, comprising:

a single, substantially flat rigid sheet designed to be placed in the hot tub, the flat sheet being designed to set on the seat and cover the foot well section to provide a support surface for a user over the foot well section, the flat sheet having a plurality of small holes for water circulation and at least one larger hole designed for a hand hold for lifting the sheet.

2. The device of claim 1, wherein the sheet has a sheet periphery, the sheet periphery being designed to mate with the hot tub periphery at the seat.

3. The device of claim 2, wherein the at least one larger hole is adjacent the sheet periphery so as to be located over the seat when the sheet is placed in the hot tub.

4. The device of claim 2, wherein the sheet is formed of plastic.

5. The device of claim 4, wherein the sheet has a bottom, and further comprising:

a plurality of ribs, integral with the sheet bottom, for strengthening the sheet.

6. The device of claim 4, wherein the rigid plastic is selected from the group consisting of PLEXIGLAS®, LEXAN® polycarbonate, acrylic, high density polyethylene, high density polypropylene, and acrylonitrile-butadiene-styrene.

7. The device of claim 2, wherein the sheet has an upwardly facing textured surface designed to reduce slippage in the wading pool.

8. The device of claim 7, further comprising:

a plurality of decals adhered to the upwardly facing textured surface.

9. A device for selectively converting a hot tub having a periphery, a seat at the periphery and a foot well section to a wading pool, comprising:

a single, substantially flat rigid sheet being designed to be placed in the hot tub and to set on the seat and cover the foot well section to provide a support surface for a user over the foot well section, the flat sheet having a plurality of small holes for water circulation; and lifting means releasably engagable with the sheet to facilitate lifting the sheet.

10. The device of claim 9, wherein the lifting means comprises at least one selectively engagable handle.

11. The device of claim 9, wherein the sheet has a sheet periphery, the sheet periphery being designed to mate with the hot tub periphery at the seat.

12. The device of claim 11, wherein the sheet has an upwardly facing textured surface designed to reduce slippage in the wading pool.

13. The device of claim 12, further comprising:

a plurality of decals adhered to the upwardly facing textured surface.

14. The device of claim 9, wherein the sheet is formed of plastic.

15. The device of claim 14, wherein the sheet has a bottom, and further comprising:

a plurality of ribs, integral with the sheet bottom, for strengthening the sheet.

16. The device of claim 14, wherein the rigid plastic is selected from the group consisting of PLEXIGLAS®, LEXAN® polycarbonate, acrylic, high density polyethylene, high density polypropylene, and acrylonitrile-butadiene-styrene.

17. A method of converting a hot tub having a seat and a foot well section to a wading pool, comprising the steps of:

obtaining a single, substantially flat sheet designed to be placed in the hot tub, the flat sheet being designed to set on the seat and cover the foot well section, the flat sheet having a plurality of small holes for water circulation and at least one larger hole designed for a hand hold for lifting the sheet, wherein the hot tub has a periphery at the seat and the sheet has a sheet periphery, the sheet periphery being designed to mate with the hot tub periphery at the seat, and placing the flat sheet in the hot tub such that the sheet sets on the seat and covers the foot well section.

* * * * *